United States Patent [19]

Winstel

[11] 4,028,817

[45] June 14, 1977

[54] APPARATUS FOR RECOVERY OF HEAT FROM EXHAUST GASES OF DRYER

[75] Inventor: Frank H. Winstel, Newtown, Ohio

[73] Assignee: Auto-Heat, Inc., Cincinnati, Ohio

[22] Filed: Sept. 29, 1975

[21] Appl. No.: 617,747

[52] U.S. Cl. ..... 34/86; 165/DIG. 2

[51] Int. Cl.[2] ..... F26B 19/00

[58] Field of Search ..... 165/DIG. 2; 34/35, 86; 432/223; 138/38

[56] References Cited

UNITED STATES PATENTS

| | | | |
|---|---|---|---|
| 167,129 | 8/1875 | Skinner | 165/128 |
| 2,818,719 | 1/1958 | Cline | 34/86 |
| 2,882,023 | 4/1959 | Rizzo | 165/DIG. 2 |
| 3,066,423 | 12/1962 | Solem | 34/86 |
| 3,232,591 | 2/1966 | Wiley, Jr. | 34/86 |
| 3,859,735 | 1/1975 | Katterjohn, Jr. | 34/86 |

FOREIGN PATENTS OR APPLICATIONS

| | | | |
|---|---|---|---|
| 52,108 | 1/1933 | Norway | 34/86 |

*Primary Examiner*—John J. Camby
*Assistant Examiner*—Larry I. Schwartz
*Attorney, Agent, or Firm*—Melville, Strasser, Foster & Hoffman

[57] ABSTRACT

Apparatus and method for recovery of heat from exhaust gases of dryers and return of heat to the dryer system. Fresh air is drawn through a plurality of tubes in heat exchange relation to heated exhaust gases and introduced into the drying system without intermingling of contaminated exhaust gases with the heated fresh air. The apparatus and method have particular utility in gas-fired commercial and industrial laundry dryers.

1 Claim, 4 Drawing Figures

APPARATUS FOR RECOVERY OF HEAT FROM EXHAUST GASES OF DRYER

BACKGROUND OF THE INVENTION

1. Field of the Invention

This invention relates to the recovery of heat from exhaust gases of laundry dryers and the return of such heat to the drying process with consequent conservation of heat energy. Although not so limited, the invention has particular utility in gas-fired commercial and industrial laundry dryers of 20 pounds to 1000 pounds capacity. The apparatus and method of the present invention result in a saving of up to 50 % of the energy requirement of an electrically heated or gas-fired laundry dryer.

2. Description of the Prior Art

U.S. Pat. No. 3,157,391, issued Nov. 17, 1964 to J. J. Angelone, discloses a device for reclaiming heat in a gas-fired dryer which includes a suction blower arranged to discharge to withdraw heated air from a lint trap beneath a rotary drum, the heated air being discharged through an upwardly extending exhaust conduit, the conduit being provided with an internal baffle which diverts a portion of the heated exhaust gases and recycles them back through the dryer for passage through the rotary drum in which the clothing being dried is tumbled.

It is apparent that the device of this U.S. patent recirculates moisture, products of combustion of the gas burner and lint back through the rotary drum. While a portion of the heat which normally would be discharged through the exhaust conduit is retained, this is off-set by the recirculation of moisture which has already been extracted from the clothing back to the clothing, together with products of combustion which may be toxic and with lint which is redeposited on the clothing. The disadvantages of such an arrangement are evident.

SUMMARY

It is a principal object of the present invention to provide an apparatus and method which will recover a substantial quantity of the heat discharged through the exhaust conduit of a laundry dryer by heat exchange with fresh dry air which is heated and conducted to a secondary burner chamber and/or a tumbler chamber, while all the moisture extracted from the clothing, gaseous products of combustion and lint are discharged to outside atmosphere. Clean dry air is heated to a temperature about 20° to 30° F less than that of the exhaust gases, thereby reclaiming from 25% to as much as 50% of the heat energy contained in the exhaust gases without recirculation of moisture and gaseous products of combustion back through the dryer.

The above object of the invention is provided in apparatus for the recovery of heat in a laundry dryer having a heat chamber means, a drying chamber which may be of the rotary drum type, a lint removal chamber, and an exhaust conduit, comprising heat exchange means positioned in the exhaust conduit, the heat exchange means including a plurality of tubes open to atmosphere at one end thereof, means securing the tubes in spaced apart, substantially parallel relation transverse to flow of heated exhaust gases through the exhaust conduit and preventing escape of the exhaust gases from the exhaust conduit, a helically twisted elongated strip inside each tube; fan means adjacent the other ends of the tubes acting to draw fresh air through the tubes, the fresh air being heated in transit by the transfer from the exhaust gases; plenum means surrounding the fan means and communicating with the other ends of the tubes for receiving the fresh air drawn therethrough while preventing intermingling of the exhaust gases therewith; and conduit means communicating with the plenum means for conducting the heated fresh air into the heat chamber means or into the drying chamber of the dryer.

The method according to the present invention comprises passing fresh air through a plurality of tubes disposed in heat exchange relationship transverse to an enclosed flow of heated exhaust gases whereby to raise the temperature of the fresh air to within 50% of that of the exhaust gases, preventing intermingling of the exhaust gases with the fresh air, conducting the heated fresh air from the tubes into the dryer for contact with clothing therein, and conducting the exhaust gases to outside atmosphere.

Preferably, the fresh air passing through each of the tubes is caused to assume a helical, turbulent flow whereby to bring all portions of the air into contact with the inner surfaces of the tubes, thus insuring optimum heat transfer efficiency.

BRIEF DESCRIPTION OF THE DRAWINGS

Reference is made to the enclosed drawing wherein.

DESCRIPTION OF THE PREFERRED EMBODIMENTS

Figure 1:
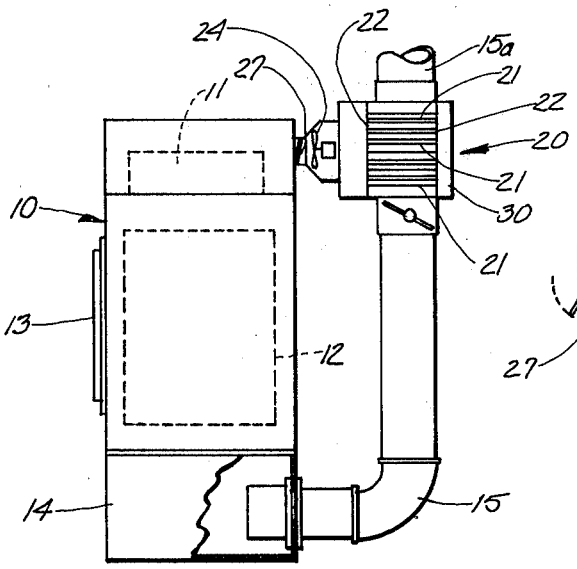
FIG. 1 is a diagrammatic side elevation, partially in section, of a laundry dryer embodying the present invention.

Referring to FIG. 1 of the drawing, a laundry dryer of conventional type is indicated generally at 10, comprising a heat chamber 11, a rotary drum drying chamber 12, an access door 13 to the drying chamber, a lint removal chamber 14 provided with a conventional lint trap or filter (not shown) and an exhaust conduit 15. Generally the exhaust conduit is arranged for discharge of heated exhaust gases upwardly to outside atmosphere.

A laundry dryer of the above type is in all respects conventional and forms no part of the present invention. In commercial and industrial laundry dryers having a capacity of 20 pounds or more, heat may be generated in the heat chamber by means of a gas burner, an electrical heating element, or steam. Although not shown in FIG. 1, a secondary heat chamber may be provided intermediate the heat chamber 11 and the drying chamber 12 in conventional manner.

Figure 2:
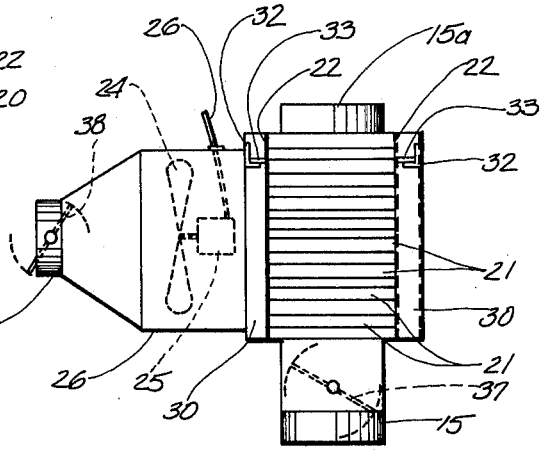
FIG. 2 is a side elevation on an enlarged scale of heat exchange means, fan means, plenum means and damper means in accordance with the invention.
Figure 3:
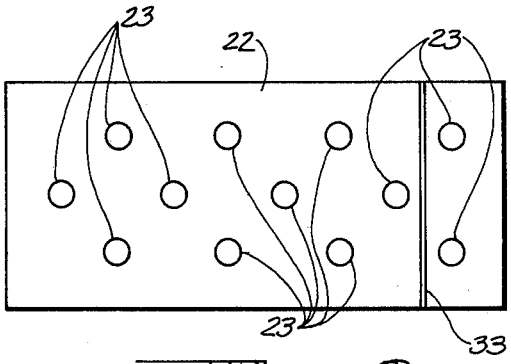
FIG. 3 is a top view of a portion of the heat exchange means of the invention.

As shown in FIGS. 1 and 2, the apparatus of the present invention includes a heat exchange means indicated generally at 20, comprising a plurality of tubes 21 open to atmosphere at the right-hand end thereof as viewed in FIGS. 1 and 2. Means 22 ae provided securing the tubes in spaced, substantially parallel relation transverse to flow of the heated exhaust gases through conduit 15. The means 22 comprise a pair of spaced parallel sheets having a plurality of apertures 23 therein, as shown in FIG. 3, equal to the number of tubes and arranged in staggered rows. An arrangement for twelve tubes is shown by way of example in FIG. 3, but it will be evident that the number may be varied. The staggered arrangement improves heat exchange efficiency. The apertures are circular and of a diameter to engage the cylindrical tubes adjacent opposite ends thereof in gas-tight relation. The sheets 22 are spaced apart from one another a distance slightly greater than the width or diameter of the exhaust conduit 15, thus permitting flow of the exhaust gases therebetween over substantially the entire length of each of the tubes 21. The construction and arrangement of the sheets 22 is such as to prevent escape of the heated exhaust gases from the exhaust conduit and to prevent intermingling of the exhaust gases with the fresh air inside the tubes 21.

Fan means 24 is provided adjacent the opposite ends of the plurality of tubes 21, comprising a suction fan wheel driven by a fractional horsepower electric motor 25, supplied by a power source 26 which is interconnected with the conventional electric motor (not shown) for driving the rotary drum drying chamber 12. Activation of the motor for rotating the drying chamber will thus also activate fan means 24.

A plenum is provided at 26 surrounding the fan means and communicating with the plurality of tubes, receiving and combining the flow of heated fresh air through each and delivering the heated air through conduit means 27 into the heat chamber means 11 of the dryer, as shown in FIG. 1. Alternatively, the heated fresh air may be delivered through suitable modification of the conduit into the drying chamber 12.

A housing is provided, as shown at 30, surrounding the tubes 21 and spaced pair of parallel sheets 22 and communicating with the plenum chamber 26. The sheets 22 are supported by channels 32 on opposing walls of housing 30 which engage projecting flanges 33 on sheets 22, the sheets and tubes being removable as a unit through an access door (not shown) by sliding them outwardly on the channels. This facilitates inspection, repair and/or replacement of the tubes and sheets.

The housing 30 is provided with a gas-tight fit with the plenum 26, and the inside dimensions thereof are the same as the dimensions of the sheet 22. Accordingly, the housing and sheets 22 co-operate to prevent intermingling of the exhaust gases in conduit 15 with fresh air passing through tubes 21 into plenum 26, while at the same time providing through passage for the exhaust gases upwardly into an extension of the exhaust conduit indicated at 15*a*.

Figure 4:
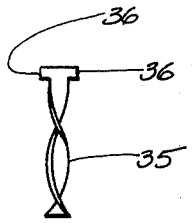
FIG. 4 is a side view of a helically twisted elongated strip adapted to be positioned in a tube of the heat exchange means of the present invention.

Referring to FIG. 4 of the drawing, a so-called turbulator 35 is illustrated. This comprises an elongated, helically twisted strip-like member having substantially the same dimensions as the inside diameter of each of the tubes 21. This member is positioned within each tube, and a pair of projecting ears 36 is provided at one end thereof to facilitate removal thereof from each tube. This helically twisted strip causes the air drawn into each tube to assume a helical turbulent flow, thus causing all portions of the air flow to come into contact with the inner surface of the tube on passage therethrough. This provides optimum heat transfer efficiency.

A quadrant damper is provided in the exhaust conduit, as indicated at 37 in FIG. 2 for regulation of the rate of flow of exhaust gases. Similarly, a quadrant damper is provided in the conduit 27 conducting heated fresh air from the plenum 26, as shown at 38 in FIG. 2, for regulating the quantity of flow of heated fresh air.

In a conventional laundry dryer the exhaust gases passing upwardly through the exhaust conduit are at a temperature of about 150° to 170° F. These gases are substantially completely saturated with moisture and contain some lint particles despite the provision of a lint trap. Additionally, in the case of a gas-fired dryer, all the gaseous products of combustion are withdrawn through the exhaust conduit. Since these may include carbon monoxide and phosgene under certain circumstances, a dangerous condition can occur if a portion of the exhaust gases is recirculated, as provided in the above-mentioned U.S. Pat. No. 3,157,391.

The heat exchange means of the present invention has a high degree of efficiency and heats fresh air to a temperature within about 20° to about 30° F. of that of the exhaust gases, i.e., to about 130°–150° F. Since the heated fresh air is then conducted directly into the heat chamber or drying chamber through a relatively short plenum and conduit, substantially no heat loss occurs after leaving the heat exchange means. All water vapor, lint and gaseous products of combustion in the exhaust gases are discharged to outside atmosphere. Since the heated fresh air is dry, much more rapid drying of clothing is obtained.

It is of course within the scope of the invention to provide either fresh room air to the tubes 21 or to connect these tubes to a source of outside fresh air.

The high efficiency of the apparatus of the present invention results in a savings of at least 25% in the energy requirement for heating a conventional commercial or industrial dryer. The power requirements for the electric motor 25 of the fan means 24 are minimal since a 1/40 horsepower motor will suffice, thus adding very little to the operating cost in comparison to the heat energy recovery.

I claim:

1. Apparatus for recovery of heat in a laundry dryer having a heat chamber means, a drying chamber, a lint removal chamber, and an exhaust conduit, comprising:

heat exchange means positioned in said exhaust conduit, said heat exchange means including a plurality of tubes open to a source of fresh air at one end thereof, means securing said tubes in spaced apart, substantially parallel staggered relation transverse to flow of heated exhaust gases through said exhaust conduit and preventing escape of said exhaust gases from said exhaust conduit, a helically twisted elongated strip inside each said tube;

suction fan means adjacent the other ends of said plurality of tubes to draw fresh air through said tubes, said fresh air being heated in transit by said exhaust gases;

plenum means surrounding said fan means and communicating with said other ends of said tubes for receiving said fresh air drawn therethrough while preventing intermingling of said exhaust gases therewith;

conduit means communicating with said plenum means for conducting said heated fresh air into said heat chamber means or into said drying chamber of said dryer;

first damper means in said exhaust conduit regulating the flow of exhaust gases therethrough; and second damper means in said conduit means regulating the flow of heated fresh air therethrough.

* * * * *